US006234848B1

(12) United States Patent
Sikora et al.

(10) Patent No.: US 6,234,848 B1
(45) Date of Patent: May 22, 2001

(54) MULTIPIN ELECTRICAL PLUG-IN CONNECTOR

(75) Inventors: Andreas Sikora, Hagen; Dirk Koburg; Harald Fischer, both of Remscheid, all of (DE)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 08/860,504

(22) PCT Filed: Oct. 12, 1996

(86) PCT No.: PCT/DE96/01948

§ 371 Date: Feb. 22, 2000

§ 102(e) Date: Feb. 22, 2000

(87) PCT Pub. No.: WO97/15962

PCT Pub. Date: May 1, 1997

(30) Foreign Application Priority Data

Oct. 28, 1995 (DE) ..... 195 40 247

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,468,162 * 11/1995 Oda ..... 439/752
5,586,918 * 12/1996 Chemin ..... 439/752
5,997,364 * 12/1999 Matusoka et al. ..... 439/752
6,080,023 * 6/2000 Meulemeester et al. ..... 439/752

FOREIGN PATENT DOCUMENTS

0667652 A1 8/1995 (EP) .
0673084 A1 9/1995 (EP) .
2248350 4/1992 (GB) .

* cited by examiner

*Primary Examiner*—Gary F. Paumen
(74) *Attorney, Agent, or Firm*—Richard A. Jones

(57) ABSTRACT

In order to design a multipole electrical connector (1) with double locking of the contact portions (2) by a finger (7) engaging in the contact portion (2) and by a thrust element (10) which can be inserted laterally in a housing (3) of insulating material, in such a way that the housing (3) of insulating material and the contact portion (2) in the insertion region are protected against damage, the thrust element (10) consists of a locking comb (11) and a cover plate (12) which are connected to each other in one piece by integrally formed transverse webs (13).

5 Claims, 6 Drawing Sheets

MULTIPIN ELECTRICAL PLUG-IN CONNECTOR

Figure 1:
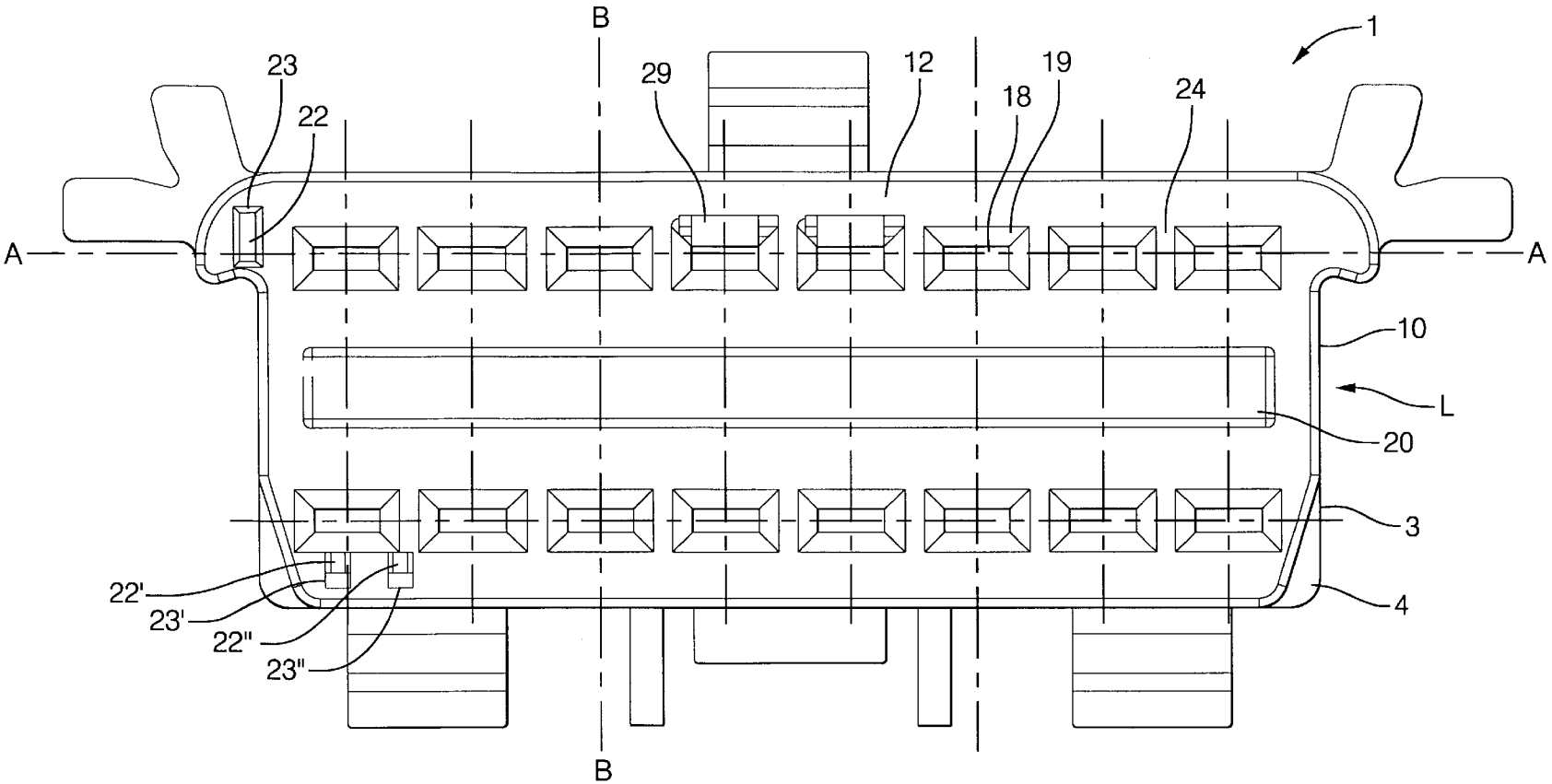

The invention starts from a multipole electrical connector according to the introductory part of claim 1.

Such an electrical connector is known from DE 4131768 A1. The connector consists of a housing and a locking device. Contact portion chambers arranged in the housing are equipped in the direction of insertion with contact portions which are primarily locked by means of resilient fingers formed integrally with the inner walls of the contact portion chambers. Final locking of the contact portions is done by a locking device which can be inserted in an opening of the housing transversely to the direction of insertion of the contact portions. The contact portion chambers end in the region of insertion at a perforated front wall of the housing. Each contact portion chamber is assigned two openings in the front wall. An insertion opening serves to receive counter contact portions, and a release opening allows deflection of the finger by means of a blade-like tool to release the contact portion.

The design of the insertion region is determined by the possible injection moulding techniques with such small constructions. The insertion opening and the release opening are arranged in such a way that no undercuts arise. Consequently the injection moulding tool or its cores are of simple construction. The insertion opening which is adapted to the cross-section of the counter contact portion protects the contact portion in the contact portion chamber visually from incorrect manipulations. The adjacent insertion opening is however due to the basic conditions of injection moulding larger than necessary and unprotected and permanently accessible both before and after assembly and secondary locking of the connector. Consequently there is a risk of damage to the contact portions and the fingers during assembly and also after mounting at the site of installation.

From U.S. Pat No. 4,557,542 is known a non-generic connector of which the contact portions are latched exclusively by means of resilient fingers extending into contact portion chambers. The latching position of the fingers is ensured with a locking strip which can be inserted in the front side of the housing. Here too after assembly of the contact portions on the housing until final mounting of the locking strip, damage to the contact portions or fingers is possible.

It is the object of the invention to design an electrical connector with double locking of the contact portions according to the introductory part of claim 1 in such a way that contact portions can be assembled on the housing variably and the housing is protected against damage in the insertion region and that it is possible to produce it with little expenditure on manufacture and mounting.

This object is achieved with the characteristics indicated in the characterising part of claim 1. The subject of claim 1 has the advantage that the combination of a locking comb and cover plate into a one-piece prefitted thrust element protects the contact portion chambers and hence also the contact portions from incorrect access. Separation of the cover plate from the housing of insulating material makes it possible to retain the proven secondary locking system and allows assembly of the housing of insulating material from both the front and rear. Coordination of the cover plate and locking comb in one piece ensures a cycle of movement in the correct sequence. Only on reaching the correct secondary locking position is connection to the corresponding counter contact portions possible due to alignment of the contact portions with the insertion openings. Due to coupling of the cover plate to the locking comb, the connector consists only of two component parts. The extraordinarily high tooling costs with such small applications fall. The contact portion chambers can be produced without complications and without undercuts which are elaborate in injection moulding, so that the injection moulding core assembly and its removal from the mould is conceivably simple.

On assembly of contact portions on the housing of insulating material in the mounting position of the thrust element and on introduction of the counter contact portions in the locking position of the thrust element, access to the contact portion chambers is possible only through precisely defined insertion openings. Only orientation of the thrust path transversely to the direction of insertion of the contact portions allows, due to the cover plate resting permanently and directly on the front side of the housing of insulating material, complete protection of the contact portion chambers already after prior mounting of the thrust element.

Within the framework of the increasing reduction in size of all components, exact and almost tolerance-free cooperation of individual elements is necessary. The cover plate and locking comb are connected to each other by transverse webs, which gives the thrust element adequate inherent stability. Within the housing of insulating material a corresponding profile opening receives the transverse webs and locking comb of the thrust element and serves as a guide channel. Consequently the movements of the cover plate on the front side are also defined. Additional guide means at the edges of the cover plate facilitate mounting and increase the precision of fitting. Both the mounting and locking positions of the thrust element are defined by complementary latch means which can be distinguished visually and also audibly.

In the cover plate is formed a longitudinal slot which is aligned with the profile opening in the insertion region, so that a pin of the mating connector can be introduced. The pin serves to secure the primary locking system and can additionally act as means for coding or centring the mating connector. The longitudinal slot moreover comprises inwardly directed edges which thus completely encapsulate the contact portion chambers.

Axial alignment of the connector and mating connector takes place by their complementary outer shapes, so that incorrect insertion is not possible. Within maximum tolerance ranges, however, initial tilting one inside the other is possible, i.e. joining at an angle. Connector systems of this kind can be equipped with individual contact portions which before the majority of contact portions must engage with their counter contact portions, so that a predefined state of connection is created first. To prevent these projecting contact portions from buckling when joined at an angle, recesses are provided at the corresponding insertion openings in the cover plate.

In case of repair, after separation of connector and mating connector the thrust element is completely removed from the profile opening and then the primary locking system of the faulty contact portion is released from the now accessible contact portion chamber with a suitable tool.

The characteristics according to the invention can be embodied both on the connector and its contact portions and on the mating connector and its counter contact portions. A sealed construction of the connector according to the invention with the known sealing concepts is also conceivable.

Figure 2:
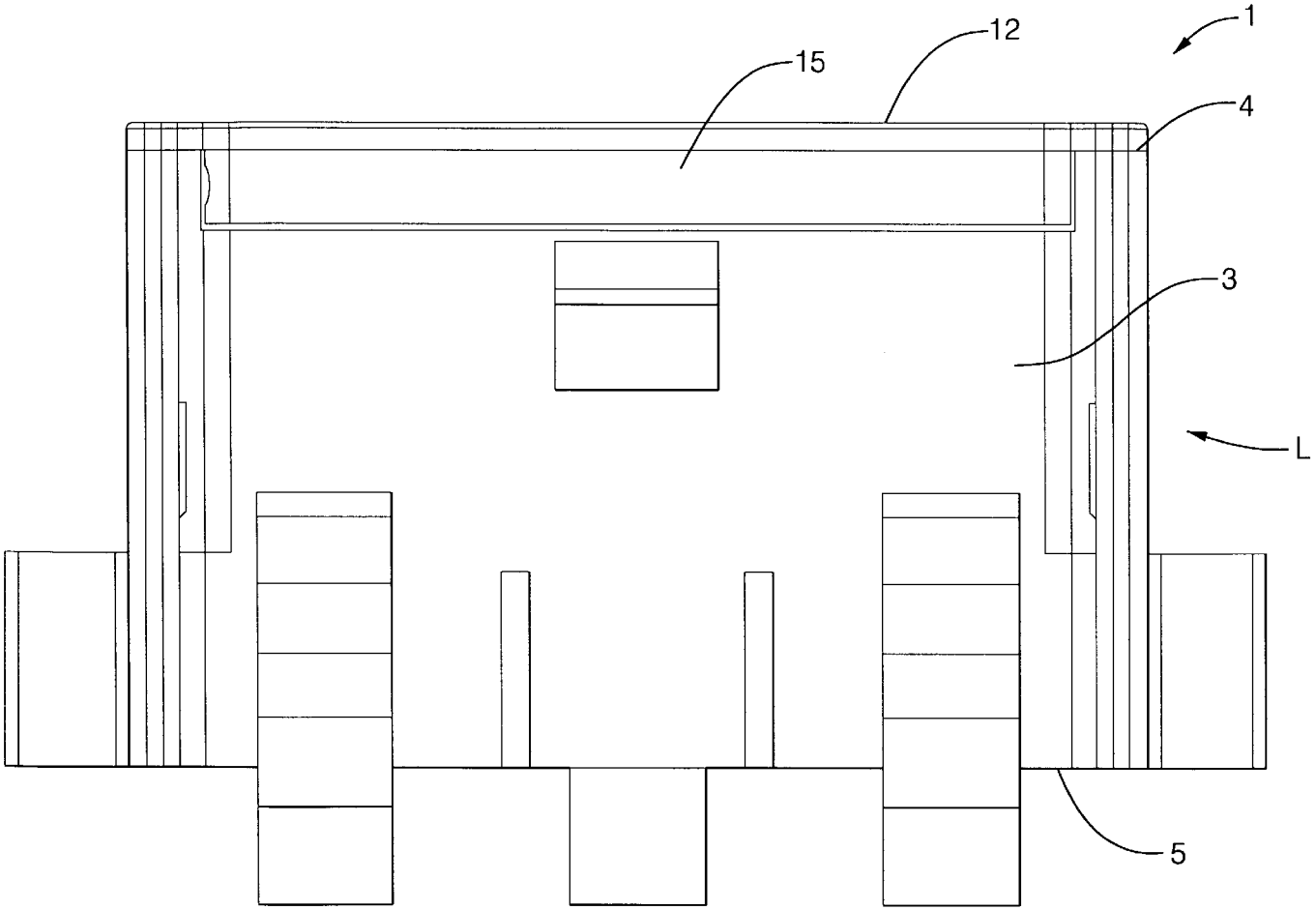
Figure 3:
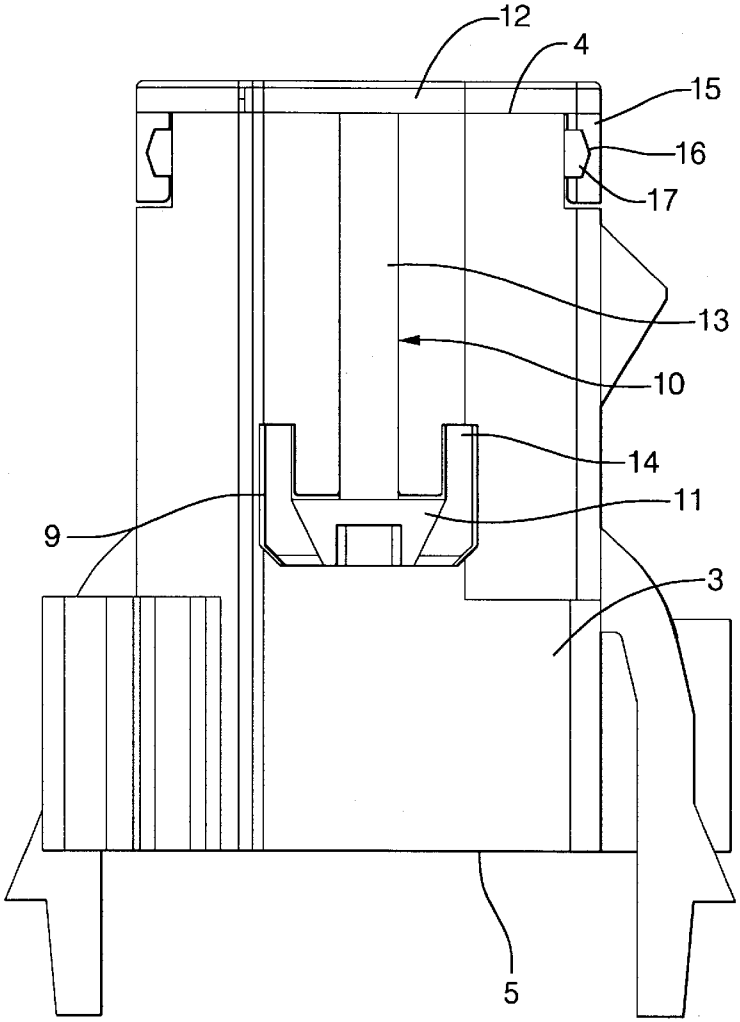
Figure 4:
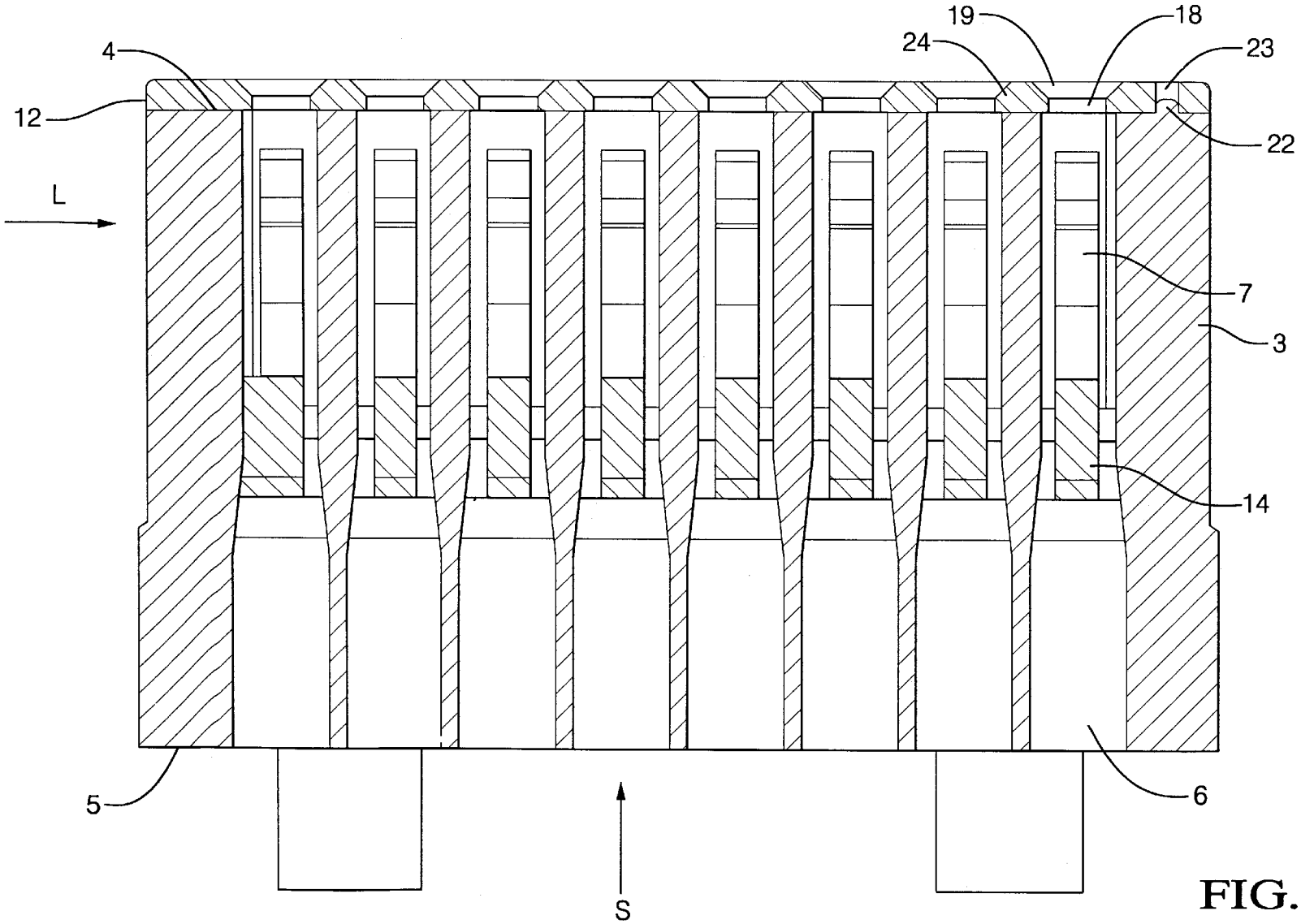
Figure 6:
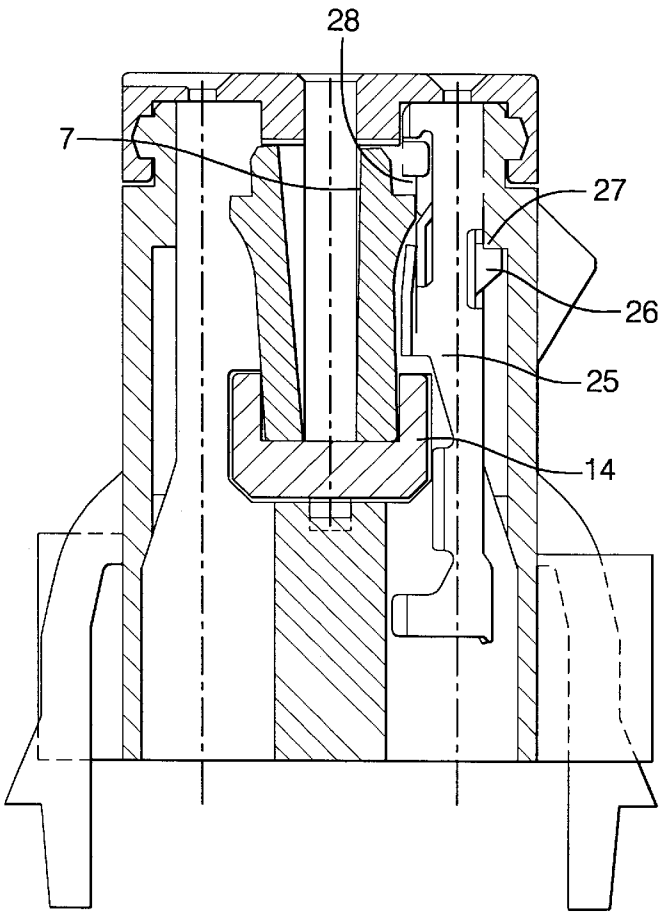
Figure 5:
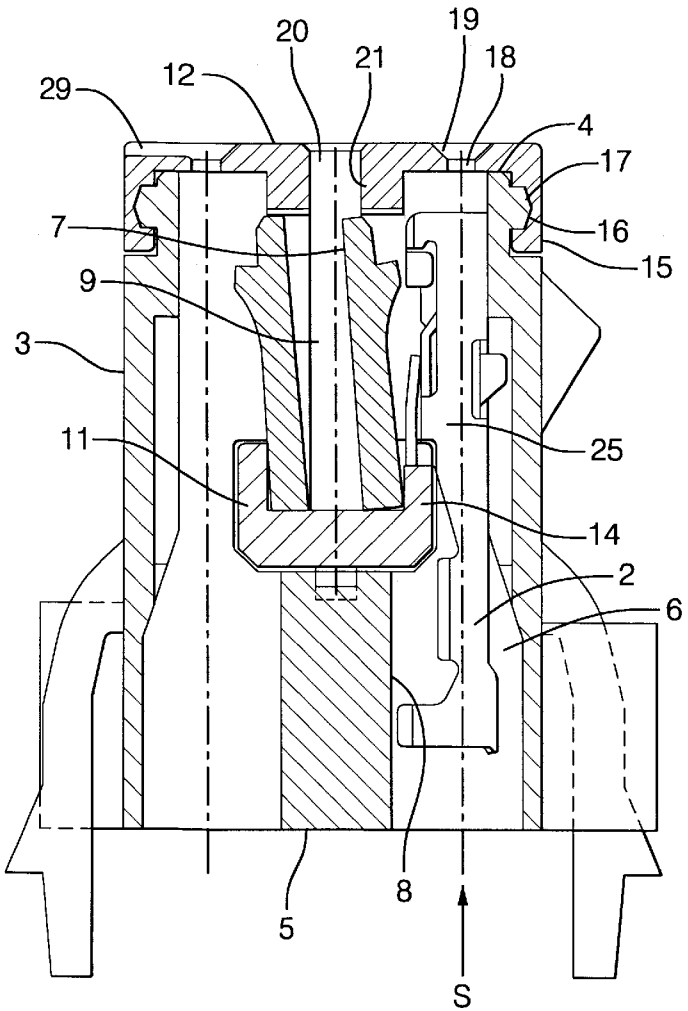
Figure 7:
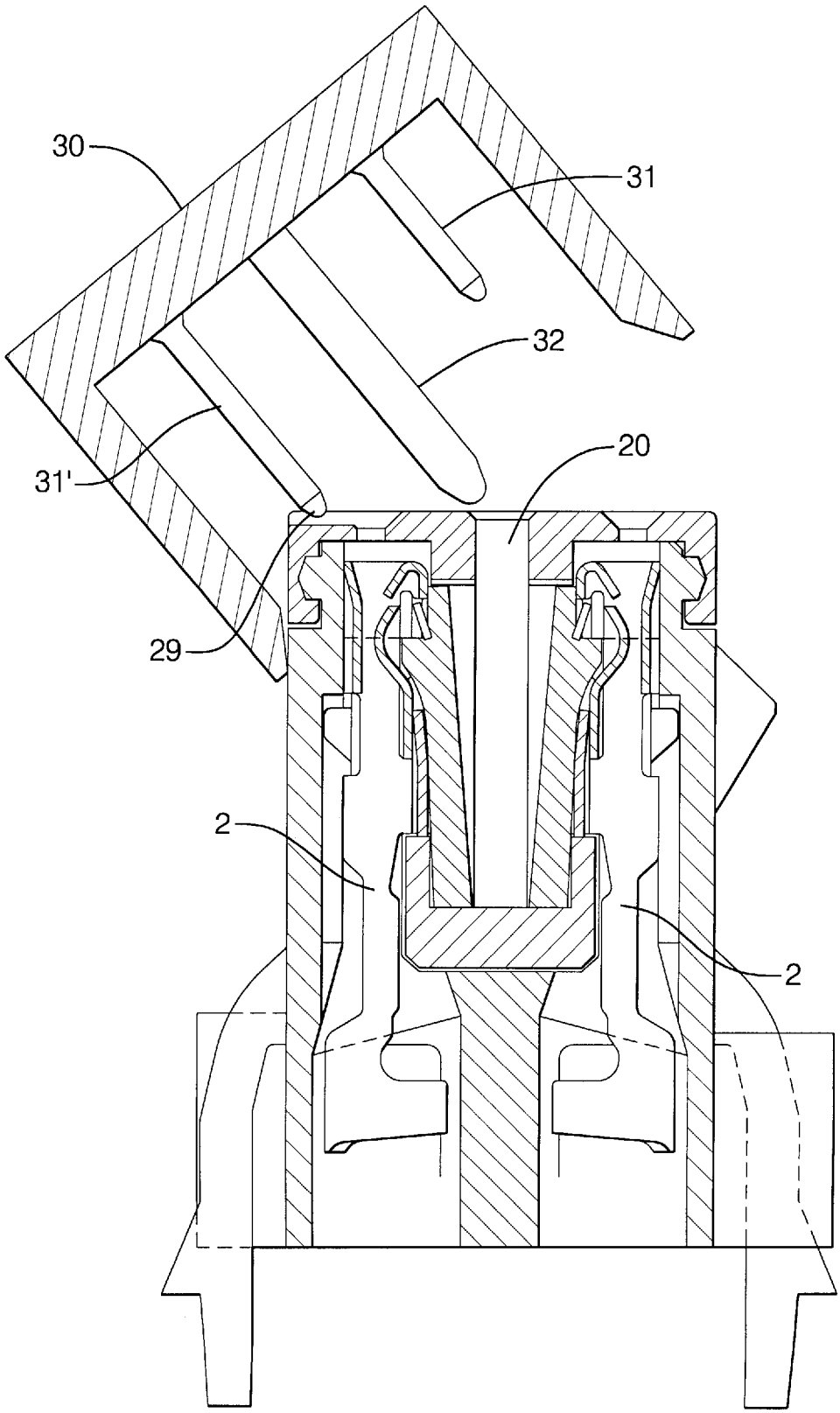

The invention is described with reference to a practical example with the aid of the drawings. They show:

FIG. 1 a view of the front side of an unassembled connector with the thrust element in the locking position introduced into a housing of insulating material;

FIG. 2 a side view of the connector according to FIG. 1;

FIG. 3 another side view of the connector according to FIG. 1 in the longitudinal direction L;

FIG. 4 a longitudinal section of the connector through line A—A in FIG. 1;

FIG. 5 a cross-section of the connector fitted with a contact portion through line B—B in FIG. 1 in the mounting position during insertion of the contact portion;

FIG. 6 a cross-section of the connector according to FIG. 5 in the locking position;

FIG. 7 a cross-section of the connector according to FIG. 6 with a mating connector shown schematically.

The figures show an electrical connector 1 and a contact portion 2 which can be inserted therein, on an enlarged scale of about 5:1. The characteristics and principles of operation of the contact portions 2 are identical, so that one contact portion 2 is described in more detail by way of example. A mating connector 30 shown schematically can be assembled with this connector 1 to form a complete connection.

The connector 1 consists of an elongate housing 3 of insulating material which is traversed from a front side 4 to a rear side 5 by contact portion chambers 6 arranged in a double row in the longitudinal direction L. In each contact portion chamber 6 for the attachment of a contact portion 2 introduced from the rear side 5 is formed a finger 7. The arrangement of the contact portion chambers 6 in rows causes opposite contact portion chambers 6 to use an inner wall 8 jointly. On either side of this inner wall 8 a resilient finger 7 extends into the respective contact portion chamber 6.

In the longitudinal direction L the housing 3 of insulating material is traversed by a plunger-like profile opening 9 which serves to receive a thrust element 10. The profile opening 9 intersects with all the contact portion chambers 6 and provides the free space for deflection of the fingers 7. The thrust element 10 can be displaced in the profile opening 9 between a mounting position and a locking position and consists of a locking comb 11 and a cover plate 12 which are connected to each other in one piece by transverse webs 13. The thrust element 10 is in the shape of an I beam, the locking comb 11 and transverse webs 13 corresponding to the profile opening 9 in cross-section. The locking comb 11 is provided with teeth 14 which in the locking position in the contact portion chamber 6 lock the contact portion 2. The cover plate 12 is arranged outside the housing 3 of insulating material on its front side 4. In the longitudinal direction L the cover plate 12 encompasses the front side 4 by edges 15 on which grooves 16 are formed on the inside. The grooves 16 cooperate with corresponding rails 17 of the housing 3 of insulating material and guide the cover plate 12 along the housing 3 of insulating material. In the cover plate 12 are insertion openings 18 arranged in a double row, which are each associated with a contact portion chamber 6 with its contact portion 2. In order to facilitate the introduction of counter contact portions 31, the insertion openings 18 are expanded with locating funnels 19. Between the rows of insertion openings 18 in the cover plate 12 is formed a longitudinal slot 20 which is aligned with the profile opening 9 and comprises an inwardly directed edge 21.

The mounting position and the locking position of the thrust element 10 are guaranteed by means of latch projections 22, 22', 22" and latch openings 23, 23', 23" which are formed integrally with the housing 3 of insulating material or with the cover plate 12. The shapes and arrangements of guide means 16, 17 and latch means 22, 23 on the housing 3 of insulating material or on the thrust element 10 which are shown in the figures are an example, as many other embodiments are possible.

The description below shows the manner of operation of the connector 1. After completion of the components of the connector 1, i.e. injection moulding of the housing 3 of insulating material and thrust element 10 and stamping and shaping of the contact portion 2, the thrust element 10 is introduced into the profile opening 9 of the housing 3 of insulating material and preassembled so as to latch. In this so-called mounting position the contact portion chambers 6 on the front side 4 are closed by webs 24 between the insertion openings 18, so that no foreign bodies can enter here. The contact portion 2 is introduced from the rear side 5 of the housing 3 of insulating material into the contact portion chamber 6. This is possible only in the mounting position, as the teeth 14 of the locking comb 11 of a thrust element 10 which has been displaced too far would block introduction of the contact element 2. The fully inserted contact element 2 abuts with its contact portion box 25 at the front against a web 24 of the cover plate 12 and with a lug 26 against a projection 27 in the contact portion chamber 6. The finger 7 which has been deflected during insertion engages resiliently in a recess 28 of the contact portion 2 and thus forms the primary locking system.

The thrust element 10 is moved further in the longitudinal direction L and latched in the locking position. Advance of the thrust element 10 is possible only if the contact portion 2 has been fully inserted in the contact portion chamber 6, because otherwise the teeth 14 of the locking comb 11 would be blocked by part of the contact portion box 25. In the locking position the teeth 14 of the locking comb 11 engage behind the contact portion box 25 and so provide a secondary locking system for the contact portion 2. The cover plate 12 is displaced likewise. The insertion openings 18 are arranged over the contact portion chambers 6, so that the counter contact portions of the mating connector can be introduced and engaged with the contact portions 2.

The mating connector 30 comprises at least one pin 32 which engages in the longitudinal slot 20 and in the profile opening 9 and additionally secures the primary locking system, i.e. the fingers 7. At the same time the primary locking system is checked. A pin 32 which cannot be fully inserted indicates that there is inadequate springback of the finger 7 into the recess 28 of the contact portion 2. Depending on the design, this pin 32 also undertakes centring or coding of the mating connector 30.

For reasons of circuitry it may be necessary to provide the mating connector 30 with counter contact portions 31, 31' of different length. Recesses 29 on the corresponding insertion openings 18 in the cover plate 12 prevent the longer counter contact portions 31 from buckling if the mating connector 30 is joined at an angle.

From the moment of preassembly of the thrust element 10 to providing the locking position, the contact portion chamber 6 or the contact portion 2 is constantly protected from damage from the outside. The fit of the cover plate 12 on the housing 3 of insulating material is ensured by integral connection to the locking comb 11 and additionally by the guide means 16, 17. The inwardly directed edges 21 of the longitudinal slot 20 close the contact portion chamber 6 almost without a gap.

List of Reference Numbers

1 connector
2 contact portion
3 housing of insulating material
4 front side

5 rear side
6 contact portion chamber
7 finger
8 inner wall
9 profile opening
10 thrust element
11 locking comb
12 cover plate
13 transverse web
14 tooth
15 edge
16 groove
17 rail
18 insertion opening
19 locating funnel
20 longitudinal slot
21 edge
22 latch projection
23 latch opening
24 web
25 contact portion box
26 lugs
27 projection
28 recess
29 recess
30 mating connector
31 counter contact portion
32 pin
S direction of insertion
L longitudinal direction

What is claimed is:

1. A multiple electrical connector comprising:

a housing (3) of insulating material which is traversed from a front side (4) to a rear side (5) by contact portion chambers (6) arranged in rows, the housing having inwardly directed resilient fingers (7) extending away from the inner walls (8) of the housing though which a profile opening (9) extends which intersects perpendicularly with the contact portion chambers (6), contact portions (2) which can be introduced into the contact portion chambers (6) and which can be primarily locked by the fingers (7) engaging in respective recesses (28) of the contact portions (2), a thrust element (10) movable between a mounting position and a locking position in the profile opening (9), the contact portions (2) being insertable into the contact portion chambers (6) in the mounting position of the thrust element (10), the thrust element (10) including a locking cam (11) and a cover plate (12) which are connected to each other in one piece by integrally formed transverse webs (13), the locking cam (11) having teeth (14) each engaging behind an edge (25) of the contact portions (2) in the locking position, the cover plate having insertion openings (18) aligned with the contact portion chambers (6) in the locking position, and a recess (29) formed in at least one insertion opening (18) in the cover plate (12).

2. A multiple electrical connector comprising:

a housing (3) of insulating material which is traversed from a front side (4) to a rear side (5) by contact portion chambers (6) arranged in rows, the housing having inwardly directed resilient fingers (7) extending away from the inner walls (8) of the housing though which a profile opening (9) extends which intersects perpendicularly with the contact portion chambers (6), contact portions (2) which can be introduced into the contact portion chambers (6) and which can be primarily locked by the fingers (7) engaging in respective recesses (28) of the contact portions (2), a thrust element (10) movable between a mounting position and a locking position in the profile opening (9), the contact portions (2) being insertable into the contact portion chambers (6) in the mounting position of the thrust element (10), the thrust element (10) including a locking cam (11) and a cover plate (12) which are connected to each other in one piece by integrally formed transverse webs (13), the locking cam (11) having teeth (14) each engaging behind an edge (25) of the contact portions (2) in the locking portion, grooves (16) and rails (17) being formed on the cover plate (12) and on the front side (4) of the housing (3) of insulating material respectively or vice-versa, so that the cover plate (12) can be guided on the housing (3) of insulating material.

3. Multipole electrical connector according to, claim 2 characterized in that complementary latch means (22, 23) are formed on the housing (3) of insulating material and on the cover plate (12) of the thrust element (10).

4. A multiple electrical connector comprising:

a housing (3) of insulating material which is traversed from a front side (4) to a rear side (5) by contact portion chambers (6) arranged in rows, the housing having inwardly directed resilient fingers (7) extending away from the inner walls (8) of the housing though which a profile opening (9) extends which intersects perpendicularly with the contact portion chambers (6), contact portions (2) which can be introduced into the contact portion chambers (6) and which can be primarily locked by the fingers (7) engaging in respective recesses (28) of the contact portions (2), a thrust element (10) movable between a mounting position and a locking position in the profile opening (9), the contact portions (2) being insertable into the contact portion chambers (6) in the mounting position of the thrust element (10), the thrust element (10) including a locking cam (11) and a cover plate (12) which are connected to each other in one piece by integrally formed transverse webs (13), the locking cam (11) having teeth (14) each engaging behind an edge (25) of the contact portions (2) in the locking portion, the cover plate having insertion openings aligned with the contact portion chambers (16) in the locking position, the insertion openings (18) being arranged in rows, and between the insertion openings (18) arranged in rows in the cover plate (12) is formed a longitudinal slot (20) through which a pin (32) of a mating connector (30) can be introduced from the front side (4) into the profile opening (9) of the housing (3) of insulating material, which fixes the fingers (7) in the contact portion chambers (6).

5. Multipole electrical connector according to claim 4, characterized in that the longitudinal slot (20) comprises an inwardly directed edge (21).

* * * * *